United States Patent [19]

Peters, Jr.

[11] 4,194,675

[45] Mar. 25, 1980

[54] PARTITION INTERLOCK CONSTRUCTION

[75] Inventor: Charles L. Peters, Jr., Norco, Calif.

[73] Assignee: Box Innards, Inc., Orange, Calif.

[21] Appl. No.: 973,906

[22] Filed: Dec. 28, 1978

Related U.S. Application Data

[63] Continuation of Ser. No. 688,049, May 19, 1976, abandoned.

[51] Int. Cl.[2] ..... B65D 5/48; B65D 85/00

[52] U.S. Cl. ..... 229/15; 217/32

[58] Field of Search ..... 229/15, 42; 217/32, 217/31, 33, 7

[56] References Cited

U.S. PATENT DOCUMENTS

| | | | |
|---|---|---|---|
| 533,331 | 1/1895 | Williams | 217/32 |
| 658,930 | 10/1900 | Starman | 217/32 |
| 1,143,036 | 6/1915 | Carter | 217/31 |
| 1,250,090 | 12/1917 | Carter | 217/31 |
| 1,528,341 | 3/1925 | Navarro | 217/31 |
| 1,987,108 | 1/1935 | Inman | 217/33 |
| 2,486,743 | 11/1949 | Haffner | 217/32 |
| 2,673,656 | 3/1954 | Cunningham | 217/32 |
| 3,203,612 | 8/1965 | Schaefer | 229/15 |
| 3,249,999 | 8/1885 | Jaeger | 217/32 |
| 4,000,845 | 1/1977 | Zeller | 229/15 |
| 4,103,818 | 8/1978 | Raubenheimer | 217/32 X |

*Primary Examiner*—Davis T. Moorhead
*Attorney, Agent, or Firm*—Perry E. Turner

[57] ABSTRACT

Interlocked partition strips are shown and described wherein each strip has a number of spaced parallel slots which divide the strip into segments or sections. All but one end segment have lock tab projections near one edge extending into the slots in one direction. Also, the one end segment and all other segments but the remaining end segment have lock tab projections spaced inwardly from such one edge, the latter projections extending through the slots in the same direction, but opposite to the direction in which the projections adjacent the edge extend. Thus, each slot has two spaced, oppositely directed lock tabs extending through it. At the opposite edge of each strip are spaced tab receiving openings to be interfitted with lock tab projections of a transverse strip. In different examples, the intersecting of two sets of such strips effects insertion of each pair of oppositely directed tabs into a respective notch and hole of another strip, into an elongated notch ofanother strip, into an elongated hole of another strip, and into adjacent holes of another strip. In each arrangement, the segments of all strips are securely locked, and the partition assembly thus formed is locked securely from end to end and top to bottom (i.e., edge to edge).

3 Claims, 9 Drawing Figures

PARTITION INTERLOCK CONSTRUCTION

CROSS-REFERENCE TO RELATED APPLICATION

This application is a continuation of my copending application, Ser. No. 688,049, filed May 19, 1976, now abandoned.

BACKGROUND OF THE INVENTION

1. Field of the Invention

This invention relates to multi-cell partitions used as separators for articles in boxes and the like.

2. Description of the Prior Art

As is well known, partition assemblies are used to divide the interior of a container into cells for goods, such as are packed in bottles, to protect them from damage in shipment. Also, it has been recognized that prior art partition assemblies lack desired stability in that cell walls formed by the ends of assembly strips are readily bent, deflected or distorted to interfere with loading the goods for shipment. For example, in U.S. Pat. No. 4,000,845 for "Partition Assembly and Partition Strips Therefor," issued Jan. 4, 1977, there is delineated the cause of such problem, viz., the strips have spaced slots in one edge which divide the strips into sections, and for each strip all but one section has a tab projection at such one edge which extends into the slot, and all such projections extend in the same direction. Thus, in an assembly of such interlocked strips, in which each tab extends into a notch or hole of another strip, the end sections are not locked and can curl from the vertical so as to prevent ready insertion of goods in the affected cells, all to the disadvantage of expensive down time on automatic loading equipment due to jamming.

The solution in the aforementioned patent takes the same approach as in earlier art, e.g., U.S. Pat. No. 658,930 for "Cell-Case Machine," despite differences in detail of tab shaping. Such solution is stated to be the reversing of the tab at one end of each strip so that the tab is removed from the section next to the end section that had none, and providing such end section with a tab that faces in the direction opposite to the other tabs.

By thus leaving an intermediate section on each strip without any supporting tab projection, the solution arrived at by the aforementioned patents merely shifts the problem from the end section of each strip to another location. In U.S. Pat. No. 4,000,845, it was concluded that the problem was less critical for an intermediate section than for the end section.

However, it is clear that the problem is still critical. The unsupported intermediate sections still curl over from the vertical for the same reasons as did the previously unsupported end sections. For example, the caliper or thickness of the partition strips occasionally cause an unsupported segment to bend from the vertical, as where the strips are thin and the partition height is relatively great as in forming cells for tall items. Also, the cupping effect of the paper products of which the strips are made is more pronounced as the strips get thinner, as happens when designing containers of smaller girth which will still hold the same size and number of items as previous containers. For such a smaller container to hold the same size and number of items, the partition assembly must accommodate the smaller space by use of much thinner partition strips. In such case, unsupported segments in relatively short and medium height partitions are also subject to curl from the vertical. Also, such tendencies are aided where stacks of such partitions in collapsed condition are stored for a time in extreme humid or dry environments before they are unpacked for use.

Despite such criticality, no solution has heretofore been available beyond that of shifting the location of an unsupported section of each strip from the end to an intermediate section. Since the problem is still present and apparent, those working in the field of partition design have accepted as fact that unsupported partition strip sections at some location on each strip must be tolerated.

SUMMARY OF THE INVENTION

This invention embraces strips and partition assemblies made therefrom wherein each strip along one edge has a number of spaced slots dividing the strip into a number of segments or sections, all but one end segment having a lock tab projection extending through a slot and facing such one end segment, all but the other end segment having a lock tab projection extending through a slot and facing such other end segment, and tab receiving openings spaced along the opposite edge aligned with the slots, whereby in a partition assembly oppositely directed lock tabs extend through each opening means and all strip segments are supported against movement from the vertical that has heretofore been permitted by virtue of partition assembly structures in which unsupported segments are present.

DESCRIPTION OF ILLUSTRATIVE EMBODIMENTS

Figure 1:
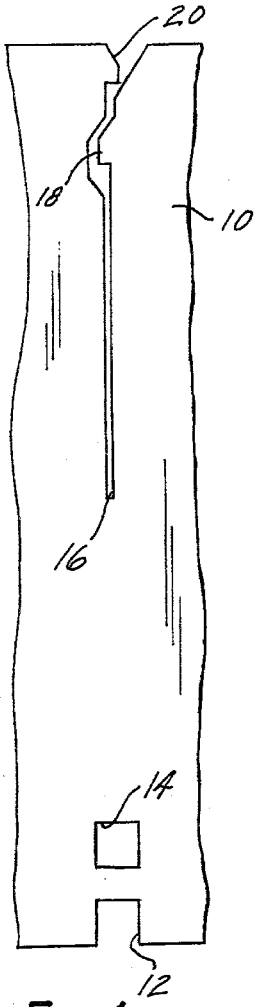
FIG. 1 is a fragmentary side elevation view of a strip for a partition in accordance with the invention, showing staggered oppositely directed loc tabs from the sides of a slot which extends towards the middle of the strip, and showing an aligned notch and hole for receiving such tabs of another strip.

Referring to FIG. 1, a strip 10 is punched at each location with a notch 12 in one edge, and a hole 14 spaced from the notch 12. At its opposite edge, the strip is slotted to provide a narrow slot 16 extending from the mid-portion of the strip and a pair of lock tabs 18, 20 spaced from the edge. The slot edges immediately adjacent the top edge of the strip are tapered to facilitate intersecting of such strips.

The tabs 18, 20 are oppositely directed, i.e., towards the opposite ends of the strip 10. Further, they overlap in that they extend in opposite directions past a line that is at right angles to the strip edges. In this example, the tabs overlap such a line extending through the center of the narrow slot 16. Also, the tabs are of such length that when two such strips are intersected, each inner tab 18 extends through a hole 14 of the other strip, and each outer tab 20 extends through the notch 12 of the other strip.

Figure 2:
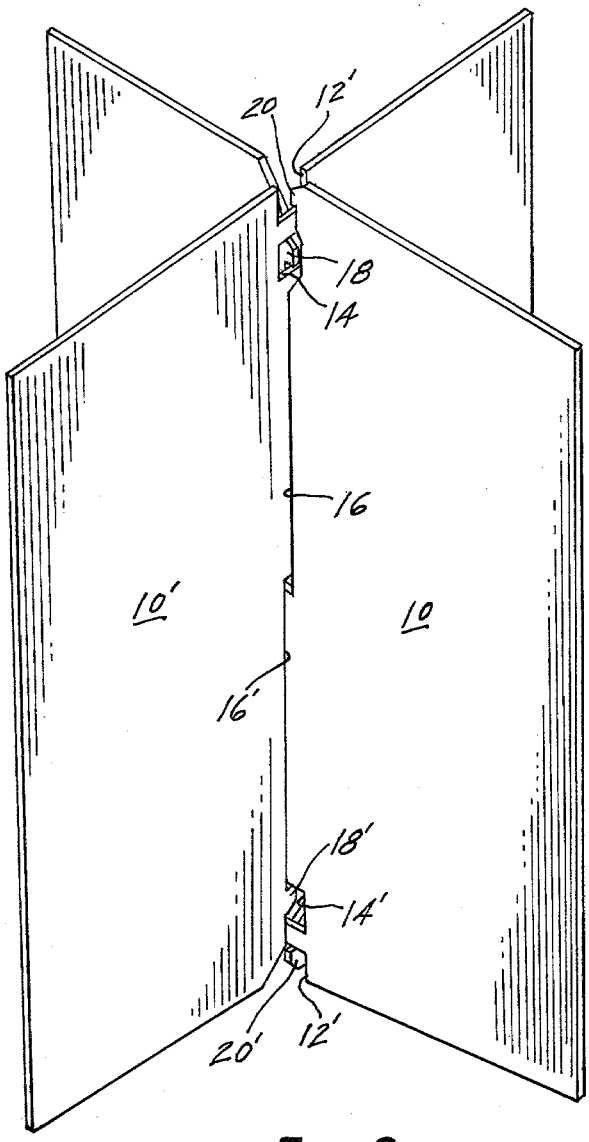
FIG. 2 is a perspective view of a pair of strips of FIG. 1 interlocked to form a four-cell partition.
Figure 3:
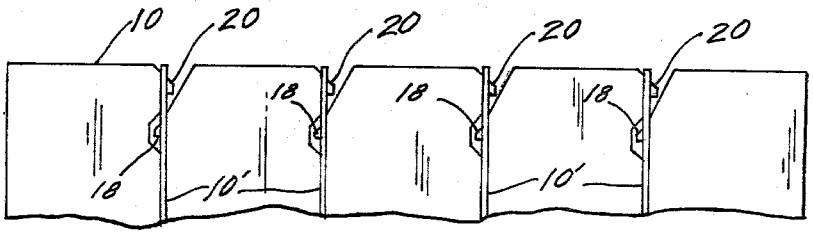
FIG. 3 is a side elevation view of the upper portion of a partition assembly formed of a plurality of strips with a plurality of lock tab pairs as in FIG. 1.

Further, and referring to FIG. 2 and FIG. 3 along with FIG. 1, the slot edges in which the tabs 18, 20 are formed are shaped with tapered and straight portions to facilitate intersecting, i.e., movement of tab portions past each other to the opposite edges of the strips and into the notches and holes 12, 14. In this regard, the slot edge passing the outer tab 20, i.e., the slot edge in which the inner tab is formed, continues at the taper or angle past the outer tab. Also, the upper portion of the inner tab is tapered as shown, and the opposite slot edge is shaped to provide clearance around the inner tab. Thus, when the slotted edge of another strip is forced along the slot as shown, the outer tab of such other strip rides past the outer tab and along the inner tab to pass along the narrow slot 16 until the bottoms of such slots are in abutment. At this point the tabs 18 extend into the holes 14 and the tabs 20 extend into the notches 12. In this example, the bottoms of the tabs 18, 20 are formed with shoulders at right angles to the slot 16, thereby to form catches for interference relation with the inner edges of the notches 12 and holes 14 for insuring against the strips being separated once the partition is opened and inserted in a box.

In FIG. 2, the strips are identical, but for ease of explanation one strip and its parts are shown with primes of the numbered parts of the other. Similarly, in FIG. 3 the one strip 10 is shown interlocked with four strips 10'. It will be understood, of course, that each strip 10' may have a number of dual tabs, notches and holes at spaced locations as represented for strip 10. Thus, the strips 10 all have tabs 18, 20 extending through respective notches and holes of the strips 10' at the tops of the strips 10', and all strips 10' have outer and inner tabs at their lower edges inserted through the notches and holes in the lower portions of the strips 10.

In FIG. 3, it will be noted that the segments of the strip 10 are all positively locked. In this regard, the end segments each have a tab extending through an opening in the adjacent strip 10', the left end segment having its outer tab 20 extending through the notch 12 of the adjacent strip 10', and the right end segment having its inner tab 18 extending through the hole 14 in the adjacent strip 10'. In similar fashion, the segments at the ends of the strips 10' are locked, as are the end segments of all strips parallel to the strip 10. Because such tabs interlock with adjacent strips at right angles, the end segments and each of the intermediate segments are not free to curl or bend over when the partition is opened and inserted in a container. Thus, this invention provides a partition lock construction which insures that the partition, when open, is securely locked in the open position with every segment held vertical, so that the time, effort and expense of man-hours heretofore spent in detecting and correcting for the effects of bent, curled or jammed segments, and in replacing damaged goods, are eliminated.

Figure 4:
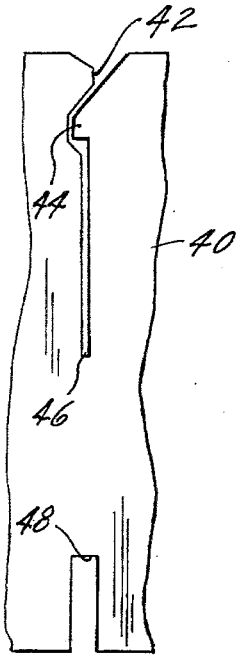
FIG. 4 is a fragmentary side elevation view of a strip with another lock tab construction of the invention, and showing an elongated notch in the edge opposite the slot for receiving the two tabs in the slot of another strip.
Figure 5:
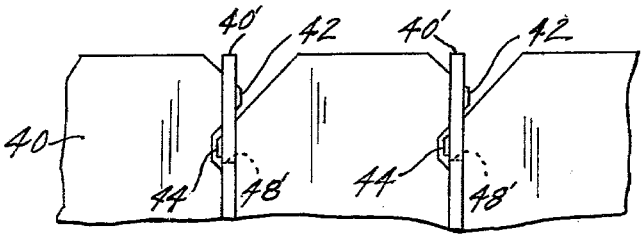
FIG. 5 is a fragmentary side elevation view of a partition assembly formed of a plurality of strips with lock tab pairs as in FIG. 4.

Referring to FIGS. 4 and 5, a strip 40 is shown with its top edge slotted to provide outer and inner tabs 42, 44 at the upper end of a narrow slot 46, and with its lower edge provided with a notch 48 deep enough to span the distance from the top edge to a point slightly beyond the lower end of the inner tab 44. In an assembled partition as shown in FIG. 5, wherein the strip 40 is interlocked with strips 40', each pair of tabs 42, 44 extend through the respective slots 48' from opposite directions. Here again, the tabs 42, 44 are overlapped so as to have their ends extending to opposite sides of the strips 40'. Thus, all segments of each strip are locked to a strip at right angles thereto. In this example, only the inner tab 44 is shown with a shoulder termination at right angles to the slot, and such shoulder may be provided to enhance interference fit with the bottom of a notch to prevent interlocked strips from being separated.

Figure 6:
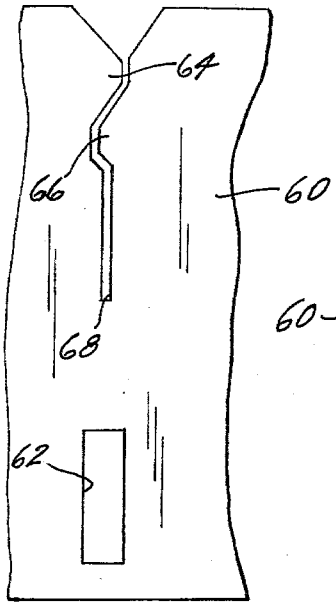
FIG. 6 is a fragmentary side elevation view of another strip with another lock tab construction of the invention, showing an elongated hole adjacent the edge opposite the slot for receiving such tabs of another strip.
Figure 7:
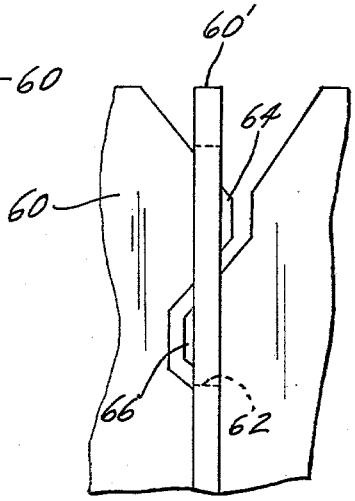
FIG. 7 is a fragmentary side elevation view of a pair of strips of FIG. 6 with tabs extending through the hole of another such strip.

FIGS. 6 and 7 illustrate another embodiment of the invention wherein each of the strips 60 to form a partition has an elongated hole 62 adjacent one edge at each locking location, and a pair of tabs 64, 66 between the opposite edge and a narrow slit or slot 68. In this embodiment, both tabs are spaced inwardly more than the tabs of the preceding embodiments because of the location of the hole 62. Here, also, the hole 62 is long enough to span the distance between the upper portion of the outer tab 64 and the lower portion of the inner tab 66. In this example, the upper and lower portions of both tabs are shown to be tapered. Since the tabs are overlapped to extend through the hole 62 from opposite directions, the strips 60, 60' interlocked with such tab and hole formations are effectively locked against separation. If desired, the inner portion of the inner tab 66 could be provided with a sharp shoulder for interference fit with the other strip at the inner end of the hole therein.

Figure 8:
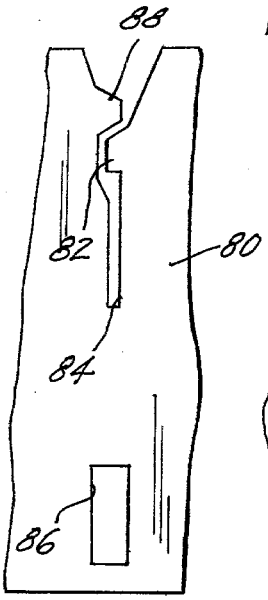
FIG. 8 is a fragmentary side elevation view of a strip like FIGS. 6 and 7, but with a different tab formation.

FIG. 8 illustrates a strip 80 of the last type mentioned, wherein an inner tab 82 has a shoulder at right angles to the narrow slit in the strip as indicated at 84. The shoulder is adapted for blocking engagement with the inner end of a hole 86 to prevent separation of a pair of such strips when interlocked with both outer and inner tabs extending in opposite directions through the hole. In this embodiment, the outer tab 88 is shown somewhat more pronounced than in preceding embodiments, in that its upper portion extends at a smaller angle to the horizontal than the immediately adjacent portion extending from the edge of the strip.

Figure 9:
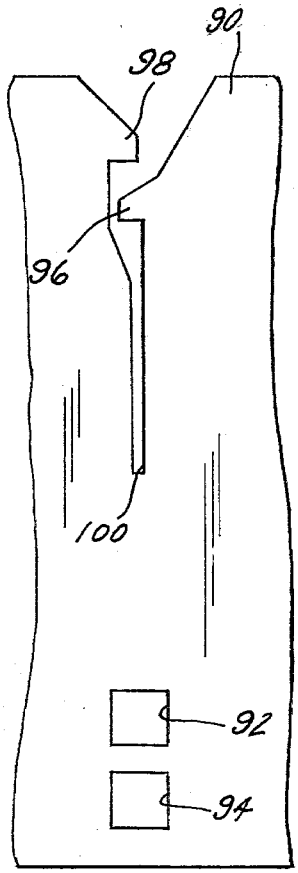
FIG. 9 is a fragmentary side elevation view of a strip of the invention wherein a pair of holes are aligned with the slot and spaced to receive such tabs of another strip.

The embodiment of the invention shown in FIG. 9 is one wherein a strip 90 has a pair of holes 92, 94 spaced inwardly from one edge thereof, and a pair of inner and outer tabs 96, 98 at the upper end of a narrow slot 100 formed in the opposite edge. In a partition made of such strips, each segment has the inner and outer tabs extending in opposite directions through the inner and outer holes 92, 94. If desired, the tabs 96, 98 may have shoulders to engage the strip through which they extend at the inner edges of the holes therein.

I claim:

1. In an open partition assembly having first and second sets of strips, the strips in each set being parallel and the strips in one set being oriented at right angles to the strips in the other set, a strip and interlock construction comprising:

an elongated element for each strip having a number of spaced slots in one longitudinal edge thereof, the slots dividing the strip into a number of segments;

respective lock tab projections adjacent said one edge extending from all but one end segment and facing said one end segment, each such projection extending through a slot;

respective lock tab projections extending from all but the other end segment and facing said other end segment and extending through a slot, said last-mentioned projections being spaced from said one edge of the strip, whereby each slot has a pair of lock tab projections extending in opposite directions from opposite sides thereof;

and said strip having lock tab projection receiving opening means spaced along the opposite longitudinal edge thereof and aligned with said slots, each opening means of one set of strips receiving both lock tab projections of a respective pair, whereby all segments of each strip in each set of strips of the assembly are supported by engagement of lock tab projections extending therefrom into opening means of the other set of strips.

2. The combination of claim 1, wherein the innermost lock tab projection of each pair has a shoulder termination parallel to said longitudinal edges of said strip element and in interference relation with the innermost portion of the opening means in which the pair of lock tab projections extend.

3. The combination of claim 2, wherein each opening means is a notch of a depth equal at least to the distance from the shoulder termination of the innermost lock tab projection to said one longitudinal edge of said strip element, and said slots extending substantially halfway through the strip elements in which they are formed.

* * * * *